United States Patent [19]

Payne

[11] Patent Number: 4,594,741

[45] Date of Patent: Jun. 17, 1986

[54] SHOWER CURTAIN RETAINER APPARATUS

[76] Inventor: Richard L. Payne, 561 Tico Rd., Ojai, Calif. 93023

[21] Appl. No.: 681,431

[22] Filed: Dec. 13, 1984

Related U.S. Application Data

[63] Continuation-in-part of Ser. No. 551,113, Nov. 14, 1983, abandoned.

[51] Int. Cl.[4] ..... A47K 3/14

[52] U.S. Cl. ..... 4/558; 4/608; 160/349 D

[58] Field of Search ..... 160/84 R, 402, DIG. 13, 160/349 D, 349 R; 4/607, 608, 557, 558

[56] References Cited

U.S. PATENT DOCUMENTS

| | | | |
|---|---|---|---|
| 865,520 | 9/1907 | Page | 160/402 |
| 2,608,250 | 8/1952 | Meyer | 160/349 R |
| 2,864,096 | 12/1958 | Garber | 4/608 |
| 3,205,547 | 9/1965 | Riekse | 160/349 R |
| 3,282,328 | 11/1966 | Mushro et al. | 4/608 |
| 3,365,684 | 1/1968 | Stemke et al. | 4/608 X |
| 3,418,666 | 12/1968 | Rockey | 4/608 |
| 3,879,806 | 4/1975 | Armstrong | 4/608 X |
| 4,077,072 | 3/1978 | Dezura | 4/608 X |
| 4,098,318 | 7/1978 | Ruegsegger | 160/349 D X |
| 4,333,187 | 6/1982 | Schuler | 4/608 |

FOREIGN PATENT DOCUMENTS

| | | | |
|---|---|---|---|
| 3245108 | 6/1984 | Fed. Rep. of Germany | 4/608 |

*Primary Examiner*—Charles E. Phillips
*Attorney, Agent, or Firm*—Jack C. Munro

[57] ABSTRACT

An elongated strip magnet assembly mounted on each side of a shower curtain to secure in a closed position the shower curtain across the access opening of a bathing enclosure preventing conducting of any water exteriorly thereof.

1 Claim, 6 Drawing Figures

SHOWER CURTAIN RETAINER APPARATUS

REFERENCE TO PRIOR APPLICATION

This application is a continuation-in-part of patent application Ser. No. 551,113, filed Nov. 14, 1983, by the same title now abandoned.

BACKGROUND OF THE INVENTION

The field of this invention relates to bathing enclosures and more particularly to a retainer for a shower curtain which is mounted in conjunction with the bathing enclosure to prevent the bathing water from being conducted exteriorly thereof.

The common form of bathing enclosure is a bathtub within which, mounted in the wall adjoining the bathtub, is a plumbing fixture known as a shower head. In gaining access to the bathing enclosure there is an enlarged access opening along one wall of the enclosure.

It is desirable to provide some means to close off the access opening during bathing in order to prevent spillage of water exteriorly from the bathing enclosure. A common way to close off the access opening has been to install slideable opaque glass panels within the access opening. These glass panels function very adequately to prevent spillage. However, such glass panels are expensive to install. Also, it has been common for individuals to slip and fall and break the panels which can cause substantial injury to the individual.

Injuries are frequent enough within commercial establishments, such as motels and hotels, that proprietors of such establishments have started not utilizing the use of such panels to close a bathing enclosure. Commercial establishments are now beginning to return to the conventional shower certain, which of course precludes the possibility of injury. However, shower curtains have been notorious for leaking. It is desirable that some means be utilized in conjunction with a shower curtain in order to prevent the possibility of leakage from along the sides of the curtains, since this is the most common place for leakage to occur.

SUMMARY OF THE INVENTION

The structure of the present invention is directed to be used in combination with a shower curtain which is in turn utilized to close of the access opening of a conventional bathing enclosure. The structure of the present invention relates to the use of elongated magnetic strips with one strip being mounted on each side of the shower curtain and a similar magnetic strip being mounted on the opposite side walls of the bathing enclosure. A magnetic strip on one side wall or curtain is to magnetically connect with a strip mounted on the side wall of the bathing enclosure to hold the shower curtain in a tightly abutting condition against the side wall of the bathing enclosure to thereby prevent leakage of water past the side wall from the bathing enclosure. A handle assembly may be utilized in conjunction with each strip mounted on each side of the shower curtain. Each handle assembly is to be operable from within the bathing enclosure and from exteriorly of the bathing enclosure in order to affect movement of the shower curtain from the retained position to an open position permitting access of the individual into and out of the bathing enclosure.

DETAILED DESCRIPTION OF THE SHOWN EMBODIMENT

Figure 1:
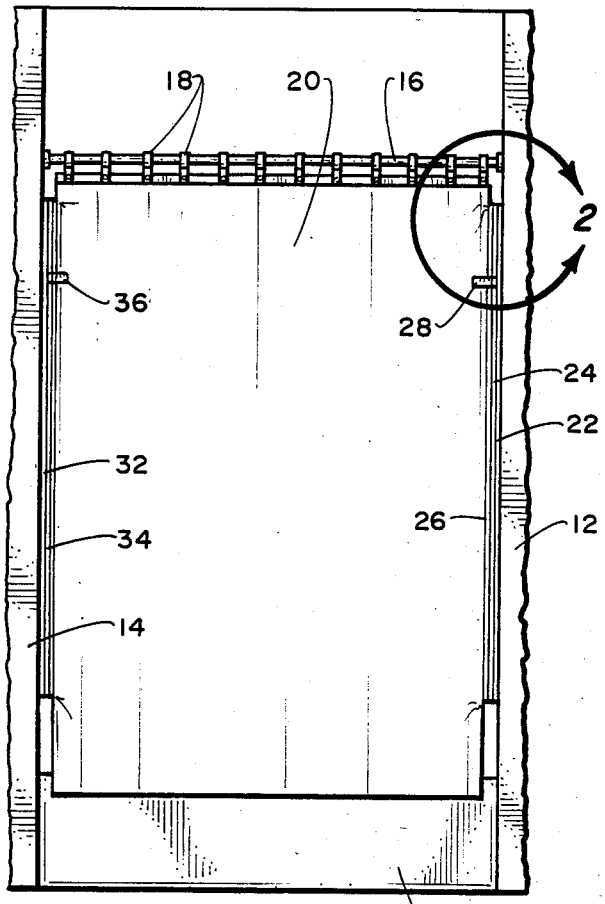
FIG. 1 is a front elevational view of a typical shower curtain installation which has attached thereto the retainer apparatus of the present invention.
Figure 2:
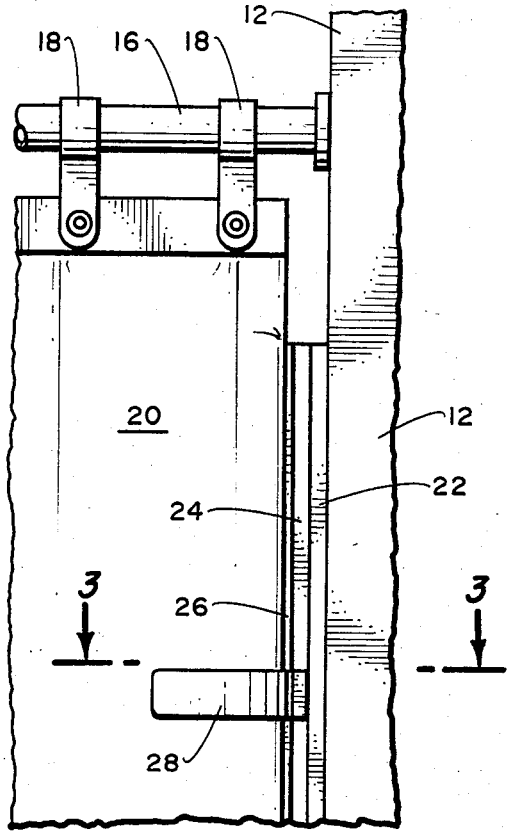
FIG. 2 is an enlarged front elevational view of a corner section of the shower curtain of FIG. 1 taken along line 2—2 of FIG. 1.
Figure 3:
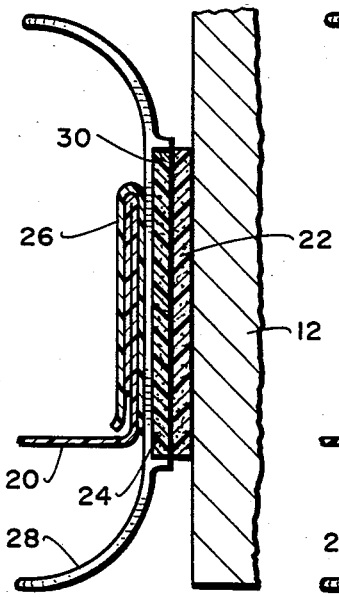
FIG. 3 is a cross-sectional view taken along line 3—3 of FIG. 2 showing the retaining means in the closed position.
Figure 4:
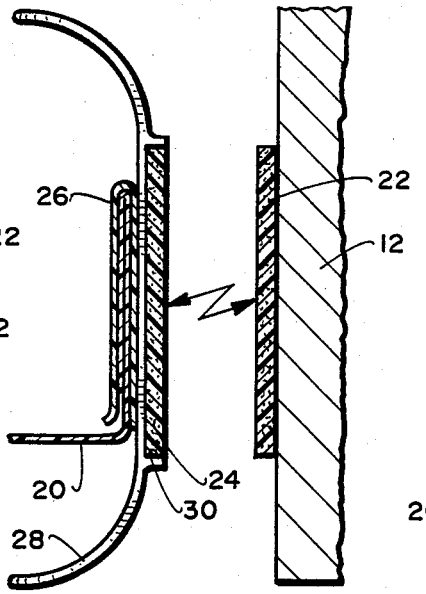
FIG. 4 is a view similar to FIG. 3, but showing the retaining means in the open position.
Figure 5:
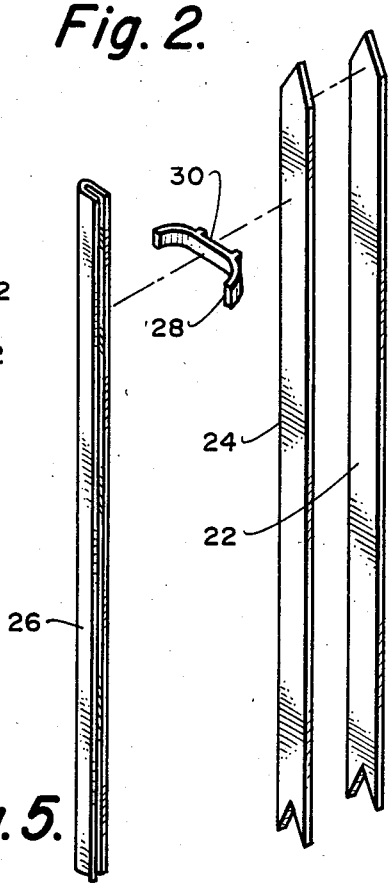
FIG. 5 is an exploded assembly view of the retainer apparatus of the present invention.

Referring particularly to the drawing there is shown a bathtub 10 which is mounted at the lowermost edges between a pair of vertical walls 12 and 14. The bathtub 10 has a recessed area for bathing (not shown). Between the vertical walls 12 and 14 is located a shower curtain rod 16. On the shower curtain rod 16 are a plurality of spaced-apart shower curtain hangers 18. The hangers 18 are connected to a conventional shower curtain 20. The shower curtain 20 will normally be constructed of a plastic material.

Mounted on the wall 12 is an elongated magnetic strip 22. The strip 22 is to be adhered to the wall 12 by means of an adhesive or double sided tape, or any other conventional fastening means. The strip 22 is deemed to be flexible prior to installation. The strip 22 is impregnated with magnetic particles that in construction of the strip 22 is deemed to be conventional and is a commercially available product. An actual construction would be barium ferrite particles impregnated in a liquid polyvinyl chloride, then solidified, then polarized.

A second strip 24 is adhesively mounted onto an elongated U-shaped bracket 26. One side edge of the shower curtain 20 is to be placed within the U-shaped bracket 26 and thereby secured thereto. Strip 24 is to be secured to the bracket 26 by means of adhesive double sided tape or other convenient fastening means. The strip 24 is to be magnetically attracted to the strip 22, thereby maintaining the edge of the shower curtain 20 in tight abutment to the wall 12 to prevent the leakage of water therethrough from the bathing enclosure.

A slight manual movement is only necessary to separate the strip 24 from the strip 22. In order to facilitate that manual movement and avoid directly grabbing the shower curtain 20, it is desirable to use the handle 28. The handle 28 is constructed of a sheet material, preferably plastic, and is to include a section which extends exteriorly of the shower curtain 20 and also interiorly of shower curtain 20. Therefore, the handle can be operated both exteriorly of the shower curtain 20 and also interiorly of the shower curtain 20. The handle 28 includes a recessed section 30. The strip 24 is to snugly fit within the recessed section 30. The flexibility of the strip 24 will just merely bend around the handle 28 in regard to its attachment to the strip 26.

On the opposite side of the shower curtain 20, there is also a similar arrangement utilizing magnetic strips 32 and 34 and a similar handle 36.

Figure 6:
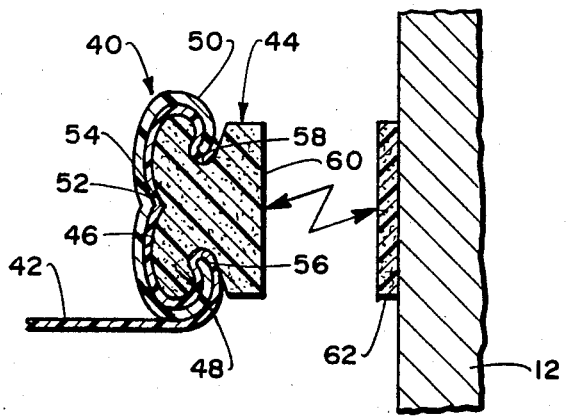
FIG. 6 is a view similar to FIG. 4 but of a modified form of retainer apparatus of this invention.

Referring particularly to FIG. 6 of the drawing, there is shown a modified version 40 of retainer apparatus of the present invention. On the wall 12 there is located a magnetic strip 62 which is basically identical to strip 22. Instead of the strip 24 there is utilized a substantially larger in cross-sectional configuration strip 44 which is constructed in a similar manner of a flat plastic which is impregnated with magnetic particles. The strip 44 has an opposing surface and a contact surface 60 the latter of which is to connect with the strip 62. Within each side edge of the strip 44 there are incorporated longitudinal recessess 56 and 58. The strip 44 is to be secured to a lateral edge of the shower curtain 42 by having the portion of the shower curtain 42 directly adjacent the lateral edge thereof positioned over the outer end of the strip 44 so that portions of the shower curtain 42 extend within the recesses 56 and 58. To secure the shower curtain 42 to the strip 44, there is utilized a deflectable clip 50. The clip 50 is forced over the outer rounded end 48 of the strip 44 in a force fit situation until the free edges of the clip 50 engage with recesses 56 and 58 binding portions of the shower curtain 42 between the clip 50 and the strip 44.

To further assist in a secure connection between the strip 44 and shower curtain 42, there is included within the interior chamber 46 of the clip 50 a protuberance 52. A mating recess 54 is formed within the strip 44. With the clip 50 engaging with the strip 44, the protuberance 52 engages with the recess 54 and binds a section of the shower curtain 42 within the recess 54.

It is to be noted that the longitudinal length of the strip 44 will be similar to the longitudinal length of the strip 24. Also, the longitudinal length of the clip 50 will be equal to the longitudinal length of the strip 44. Because the physical cross-sectional size of the strip 44 is substantially larger than the strip 24, it is not necessary to utilize a handle such as handle 28. Also, it is to be understood that the strip 44 will be flexible similar to strip 24.

What is claimed is:

1. In combination with a bathing enclosure, an access opening providing access into said bathing enclosure, said access opening terminating in side walls, a curtain positioned in said access opening, said curtain being movable between an open position and a closed position, said open position permitting entry by a human being through said access opening, said closed position forming a substantially watertight barrier between said bathing enclosure and the ambient, a retainer apparatus comprising:

means attached to both said curtain and said side walls for maintaining said curtain in said closed position, said means including magnets, said magnets being formed of flexible plastic impregnated with magnetic particles and being formed into elongated first strips and second strips, each said first strip having a contact surface, an opposing surface and a pair of lateral walls extending between said contact surface and said opposing surface, each said lateral wall and said opposing surface having a recess therein, with a rounded end being formed between each said lateral wall recess and said opposing surface recess, a clip having a pair of longitudinal free edges inturned toward each other and a longitudinal protuberance, a second said strip being mounted on each said side wall, each said second strip being attached to a lateral edge of said curtain by placing said curtain over at least the recesses of said first strip, said clip being flexible and having said free edges forced over said rounded ends into engagement with said lateral wall recesses with said protuberance extending into said opposing wall recess to provide a mating clamp of said curtain between said clip and said first strip, said first and second strips being placed into contact to maintain said water tight barrier.

* * * * *